US008060990B2

(12) United States Patent
Pascal et al.

(10) Patent No.: US 8,060,990 B2
(45) Date of Patent: Nov. 22, 2011

(54) BINDING BUCKLE WITH SECURE DOCKING ELEMENT

(75) Inventors: Jean-Marc Pascal, Voreppe (FR); Laurent Perret, Voiron (FR); Christophe Papon, Montferrat (FR)

(73) Assignee: Skis Rossignol, Saint-Jean de Moirans (FR)

( * ) Notice: Subject to any disclaimer, the term of this patent is extended or adjusted under 35 U.S.C. 154(b) by 939 days.

(21) Appl. No.: 11/657,947

(22) Filed: Jan. 25, 2007

(65) Prior Publication Data

US 2007/0175067 A1 Aug. 2, 2007

(30) Foreign Application Priority Data

Jan. 27, 2006 (FR) ..... 06 00746

(51) Int. Cl.
*A43B 5/04* (2006.01)
*A63C 9/00* (2006.01)

(52) U.S. Cl. ..... 24/71 ST; 24/71 J; 280/14.22; 280/633; 36/50.1

(58) Field of Classification Search ..... 36/50.5; 24/68 R, 68 SK, 71 SK, 70 SK, 69 SK
See application file for complete search history.

(56) References Cited

U.S. PATENT DOCUMENTS

| | | | | |
|---|---|---|---|---|
| 2,141,068 | A * | 12/1938 | Myrberg | 24/71 J |
| 4,112,557 | A | 9/1978 | Salomon | |
| 4,433,457 | A * | 2/1984 | Chalmers et al. | 24/68 SK |
| 5,745,959 | A | 5/1998 | Dodge | |
| 5,768,804 | A | 6/1998 | Goggia et al. | |
| 6,604,746 | B1 * | 8/2003 | Sato et al. | 280/14.22 |
| 6,694,644 | B2 * | 2/2004 | Haupt | 36/50.5 |
| 2001/0013157 | A1 | 8/2001 | Giancarlo | |
| 2002/0000707 | A1 | 1/2002 | Couderc | |

FOREIGN PATENT DOCUMENTS

| | | | |
|---|---|---|---|
| EP | 0 401 202 | A | 12/1990 |
| EP | 0 401 202 | B | 7/1994 |
| EP | 0 705 545 | A | 4/1996 |
| EP | 0 705 545 | B | 5/1999 |
| EP | 1 159 885 | A | 12/2001 |
| EP | 1 386 554 | A | 2/2004 |
| EP | 1 386 554 | B | 11/2004 |
| EP | 1 611 811 | A | 1/2006 |
| FR | 2 363 294 | | 9/1976 |
| FR | 2 578 057 | | 7/1998 |
| WO | WO 97/28859 | | 8/1997 |

* cited by examiner

*Primary Examiner* — Jack W. Lavinder

(74) *Attorney, Agent, or Firm* — Frommer Lawrence & Haug LLP; Ronald R Santucci

(57) ABSTRACT

A closure and tightening device buckle comprising a tightening lever (5; 25; 25'; 45; 45') wherein it comprises a docking element (7; 27; 27'; 47; 47'), wherein the tightening lever (5; 25; 25'; 45; 45') is mounted so as to be able to rotate about a shaft (8; 28; 28'; 48; 48') relative to the docking element (7; 27; 27'; 47; 47') and wherein it comprises a docking lock (11; 31; 31'; 51; 51') capable of locking/unlocking a binding of the docking element (7; 27; 27'; 47; 47') on a matching insert (2; 22; 22'; 52; 52').

24 Claims, 11 Drawing Sheets

BINDING BUCKLE WITH SECURE DOCKING ELEMENT

This application claims priority benefits from French Patent Application No. 06 00746 filed Jan. 27, 2006

BACKGROUND OF THE INVENTION

The invention relates to a buckle of a binding and tightening device of a sport boot on a sliding board, particularly suited to the snowboarding bindings, allowing two levels of binding. It also relates to an application of such a buckle in a device for the tightening and closure of rigid boots of the ski boot type. It finally relates as such to several devices incorporating the buckle of the invention such as a device for attaching a boot to a sliding board and a sliding board fitted with such a binding device and a sport boot with such a device for its closure and tightening.

DESCRIPTION OF THE PRIOR ART

The devices for attaching and tightening a boot to a surfboard of the prior art are for example illustrated by documents WO9728859 and FR2758057. They rely on straps that cover the upper of the boot and are furnished with a rack-based tightening device. The disadvantage of such devices arises from the fact that, when they are loosened, the user must again seek the correct tightness by trial and error in order to go snowboarding again. These devices therefore lack flexibility and are not user-friendly.

Certain closure and tightening devices of a ski boot, such as those described by documents FR2363294, EP0705545, or U.S. Pat. No. 5,768,804, provide buckles allowing an auxiliary temporary coupling for the purpose of making closure and tightening easier. These solutions are not however secure since the temporary position is unstable and may be unintentionally lost. These solutions therefore are not suitable for devices for attaching a boot to a sliding board for which it is important to guarantee the retention or nonretention of the boot, and on which much greater forces are exerted. In addition, these solutions of the prior art are used to facilitate tightening and intervene randomly for loosening, while requiring awkward and user-unfriendly operation by the user. Loosening the boot usually causes the boot to open totally. Finally, these solutions are often clumsy and not very user-friendly.

SUMMARY OF THE INVENTION

A first object of the present invention consists in proposing a buckle of a closure or binding and tightening device suitable for the devices for attaching a boot to a sliding board.

A second object of the present invention consists in proposing a buckle of a closure or binding and tightening device that uses secure bindings, in a user-friendly and uncumbersome manner.

The invention is based on a closure and tightening device buckle that comprises a docking element and docking lock capable of locking/unlocking a binding of the docking element on a matching insert.

More precisely, the buckle of the closure and tightening device also comprises a tightening lever mounted so as to be able to rotate about a shaft relative to the docking element, this shaft being able to be positioned at the end of the docking element.

According to an advantageous embodiment, the docking lock is distinct from the tightening lever and from the docking element and is mounted so as to rotate relative to the docking element, where necessary mounted so as to be able to rotate about the same rotation shaft relative to the docking element as the tightening lever.

According to a variant embodiment, the docking lock has one end in the shape of a hook capable of interacting with a matching opening on an insert.

A return spring can act on the docking lock to tend to rotate it into the closed position and the docking lock may have a protuberant end allowing it to be operated in the direction opposite to the force of the spring. This return spring may also act on the tightening lever to tend to rotate it in the direction of loosening by separating it from the docking element.

The docking lock is such that its manual actuation releases the docking element and the tightening lever.

In addition, a linking element may be mounted so as to be able to rotate on the tightening lever on another shaft distinct from the rotation shaft of the tightening lever.

The buckle may also comprise a lever lock to secure the closed position of the tightening lever while preventing any accidental opening.

The invention also relates to a closure and tightening device comprising a buckle as described above, connected to a first end of a base of a device for attaching a boot to a sliding board, and an insert mounted on the second end of the base of this device for attaching a boot to a sliding board.

The insert of this device may have a vertical plate interacting with a lower opening of the docking element of the buckle and the vertical plate may comprise an opening interacting with the docking lock of the docking element. According to a worthwhile variant, the lower opening of the docking element is funnel-shaped to make the insert easier to insert.

The buckle may have a lever lock mounted so as to be able to rotate about a shaft toward one end of the tightening lever and comprising a hook-shaped end to interact with an opening of a vertical plate of the insert, an opening that may also extend to the upper end of the plate in order to allow the release of the tightening lever and of the whole buckle in case the docking lock opens.

According to a variant embodiment, the buckle may have a lever lock mounted so as to move on the docking element and interacting with a shaft of the tightening lever. In this case, the buckle may have a trigger allowing the retraction of the shaft of the tightening lever or a notch for manual access to the lever lock in order to allow the manual opening of the tightening lever and the return to the docking position.

The docking lever may have a protuberant end in the tightened position of the device making it possible, by its actuation, to totally release the buckle from the insert.

The invention also relates to such a device used to attach a surf boot.

It also relates to a sliding board as such comprising a binding and tightening device described above.

Finally, it also relates to a sport boot with flaps comprising a buckle as described above for its closure and tightening.

DESCRIPTION OF THE DRAWINGS

These objects, features and advantages of the present invention will be explained in detail in the following description of particular modes of execution given in a nonlimiting manner with reference to the attached figures in which.

DESCRIPTION OF THE PREFERRED EMBODIMENTS

Figure 3:
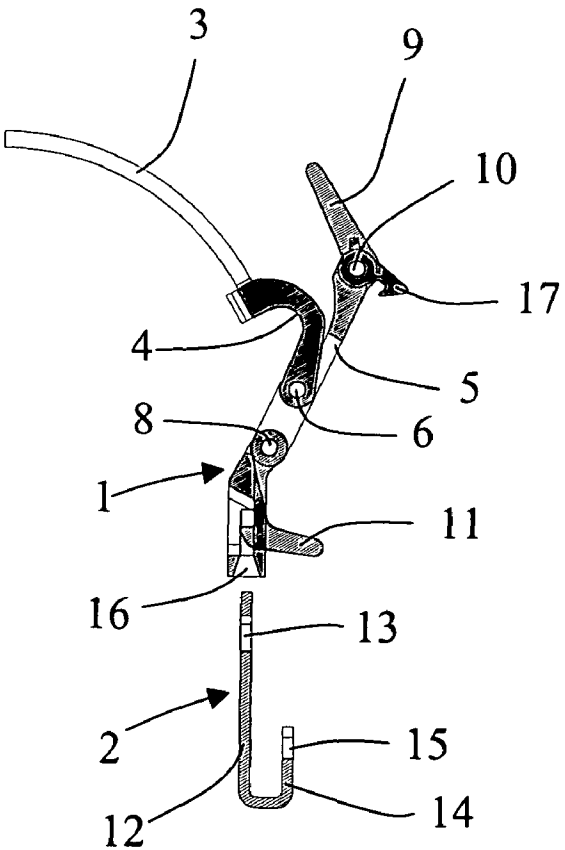
FIG. 3 represents a side view in section through a substantially central sectional plane passing at the docking lock of the buckle of a surf boot binding device in an open position according to the first mode of execution of the invention.
Figure 2:
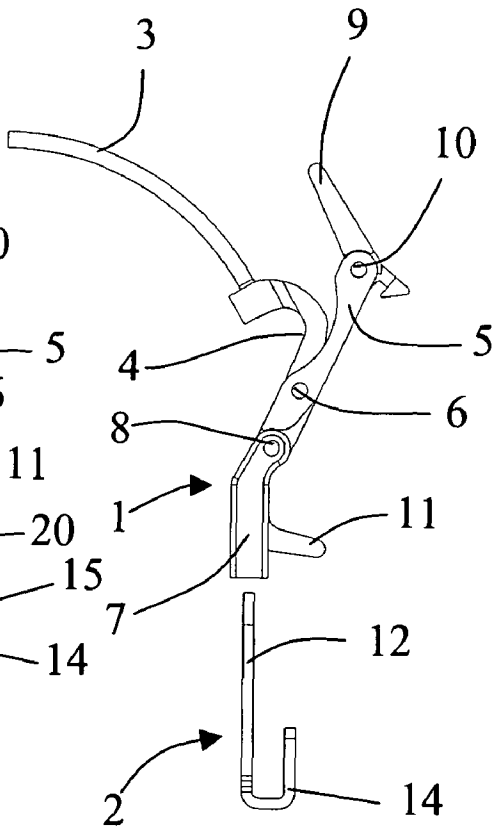
FIG. 2 represents a side view of the buckle of a surf boot binding device in an open position according to the first mode of execution of the invention.
Figure 1:
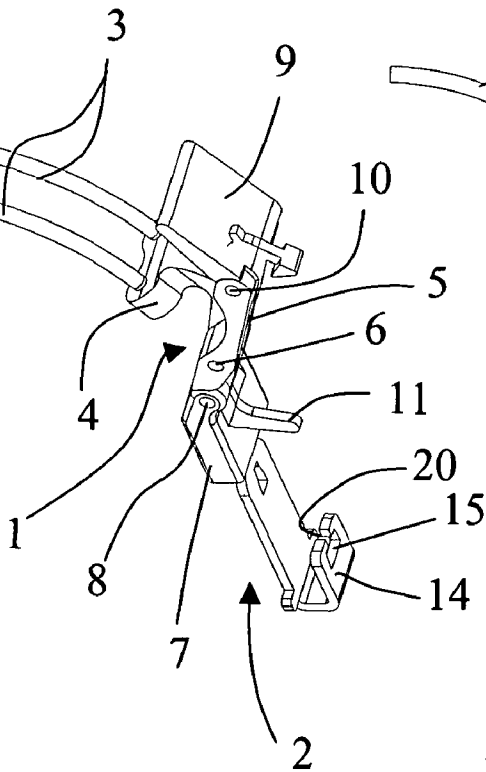
FIG. 1 represents a view in perspective of a buckle of a surf boot binding device in an open position according to a first mode of execution of the invention.

The surf boot binding device illustrated in FIGS. 1 to 7 consists of a binding buckle 1 connected to a first side of a base 19 of a snowboard binding, via cables 3, or any other known equivalent means such as webbing or strap, and a fixed insert 2 positioned on a second opposite side of the base 19 of the snowboard binding, designed to interact with the binding buckle 1.

This binding buckle 1 consists of a link 4 connecting the cables 3 to a tightening and closure lever 5, this link being mounted so as to be able to rotate on this lever 5 about a shaft 6 positioned in its central portion. This tightening and closure lever 5 is connected via a first end to a docking element 7 on which it is mounted so as to be able to rotate about a shaft 8. It comprises a lever lock 9 mounted so as to be able to rotate about a shaft 10 toward its second end. Finally, the buckle 1 also comprises a docking lock 11 positioned on the docking element 7.

Figure 7:
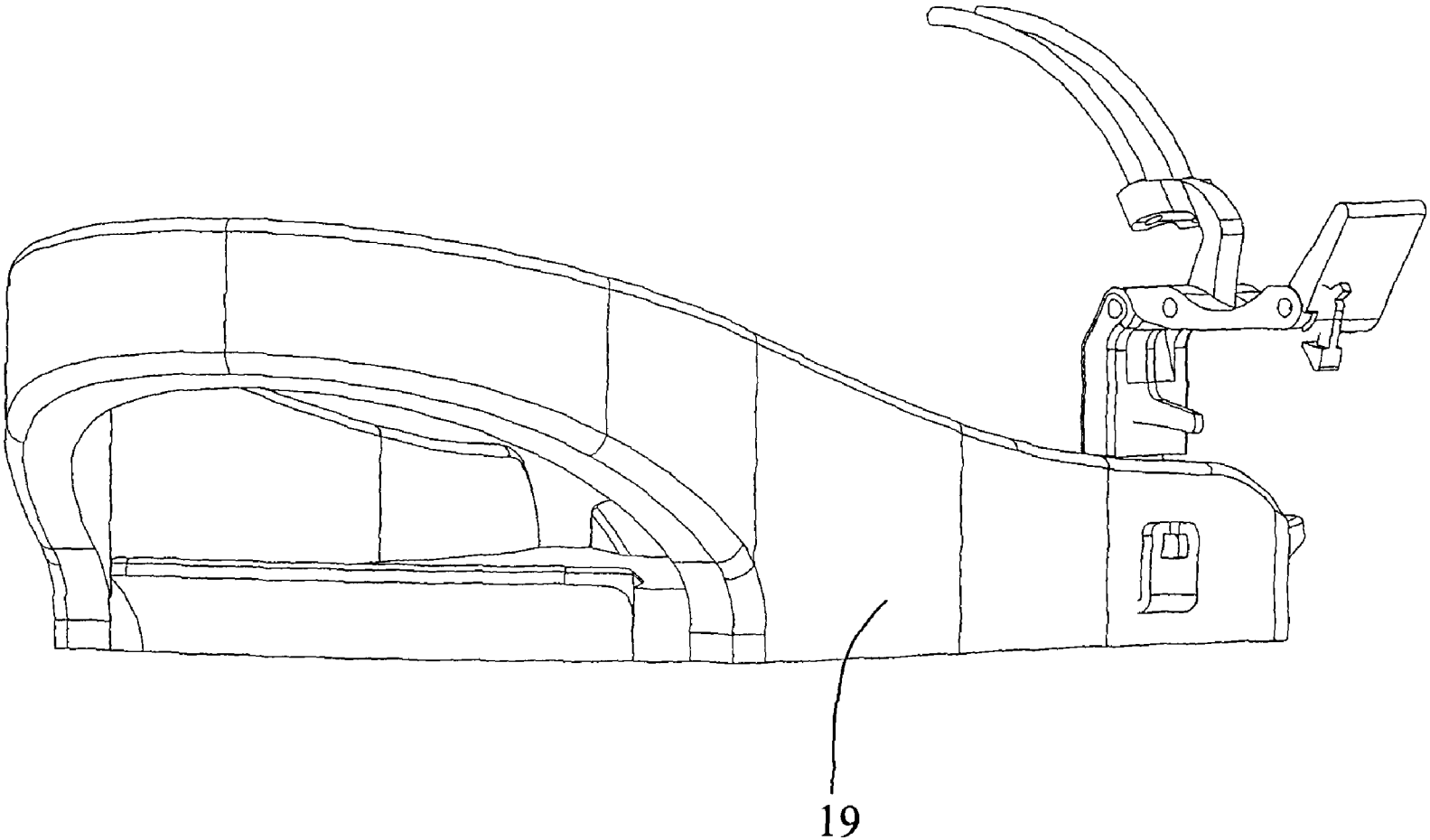
FIG. 7 represents a view in perspective of the buckle of a surf boot binding device in an intermediate docking position according to the first mode of execution of the invention.
Figure 8:
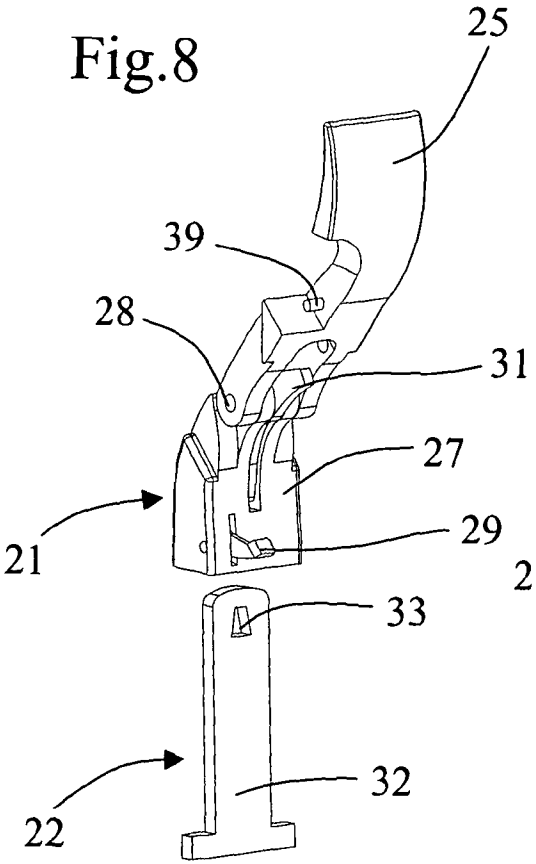
FIG. 8 represents a view in perspective of a buckle of a surf boot binding device in an open position according to a second mode of execution of the invention.
Figure 9:
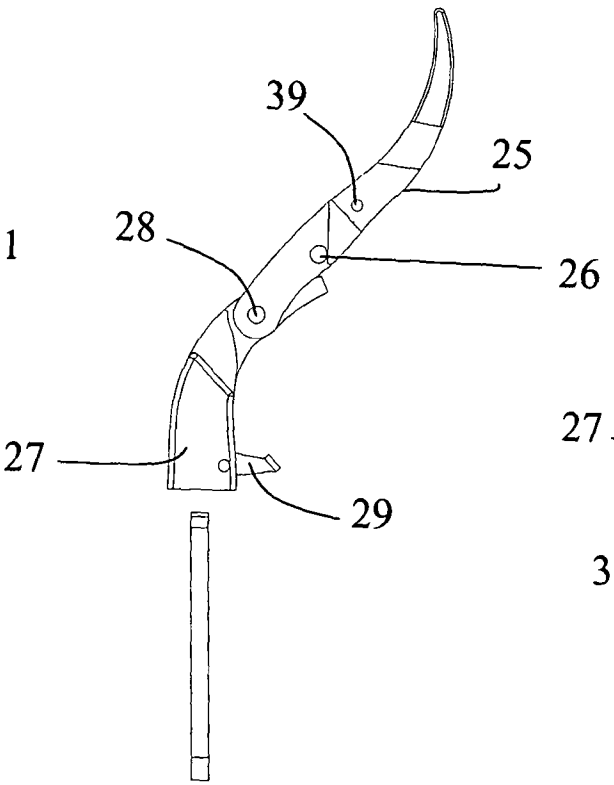
FIG. 9 represents a side view of the buckle of a surf boot binding device in an open position according to the second mode of execution of the invention.
Figure 10:
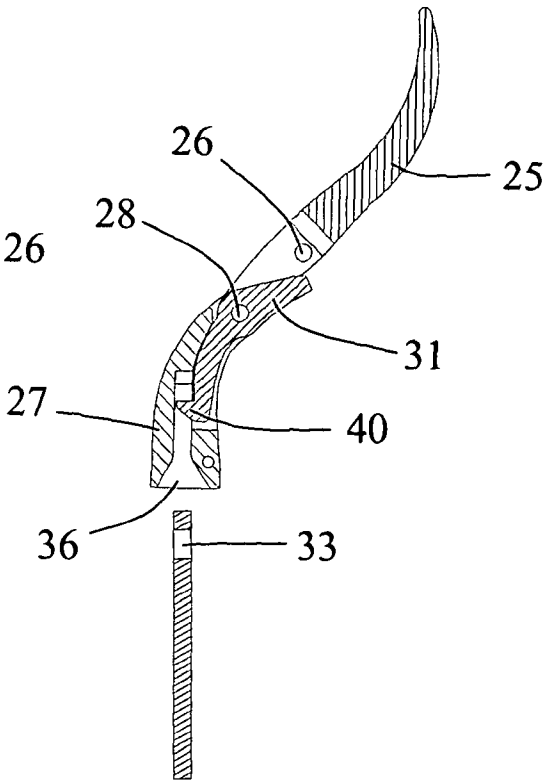
FIG. 10 represents a side view in section through a substantially central sectional plane passing at the docking lock of the buckle of a surf boot binding device in an open position according to the second mode of execution of the invention.

The insert 2, designed to interact with this buckle 1, comprises a U shape whose first highest branch 12 comprises an opening 13 designed to interact with the docking lock 11 and whose second lowest branch 14 similarly comprises an opening 15 designed to interact with the lever lock 9 of the buckle 1. It is positioned on a side wall of the base 19 of a snowboard binding so that its opening 13 is in the vertical extension of the wall of the base, the second branch 14 being situated on the side external to the base, as illustrated in FIG. 7. As variants, the insert 2 could be directly mounted on the base, or on a hoop placed behind the base. It may be attached by any means, and even be a portion of the base by being machined with the base or formed directly when the base is molded.

This binding buckle allows an operation comprising two phases. A first docking phase consists in attaching the docking element 7 to the insert 2 and makes it possible to reach a stable and secure intermediate position thanks to the docking lock 11 preventing the accidental release of the buckle 1 in this docking position. This position is illustrated in FIG. 7. It is achieved by the insertion of the first branch 12 of the U of the insert 2 through the lower opening 16 until the docking lock 11 of the buckle 1 is clipped into the opening 13, thus making it possible to obtain a stable and locked docking position. In this position, the boot is not sufficiently tightened into the binding for the practice of snowboarding but it is however held in the binding device with a slight tightening which provides comfort to the foot of the user. This position is for example useful in the intermediate phases between two descents, in particular when the snowboarder takes a mechanical lift. This position may be unlocked at any time by an action on the docking lever 11. This docking position also simplifies the closure phase of the binding while representing a stable intermediate step obtained after a first effort of the user, serving as a starting point for a tightening phase, while ensuring that there will be no sudden regression toward a total release of the buckle 1.

Figure 6:
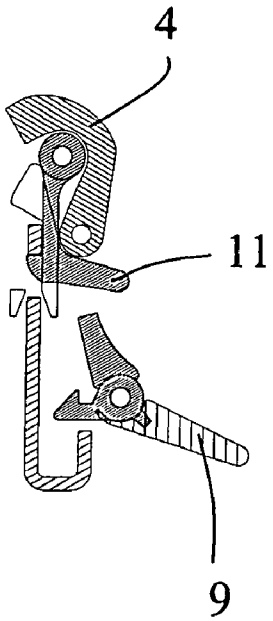
FIGS. 4 to 6 represent the same illustrations as above of the surf boot binding according to the first mode of execution of the invention but in a closed position.
Figure 5:
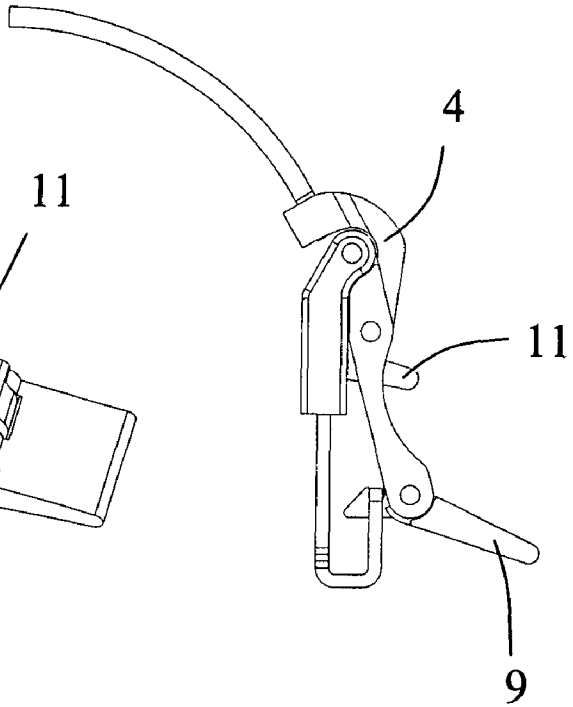
Figure 4:
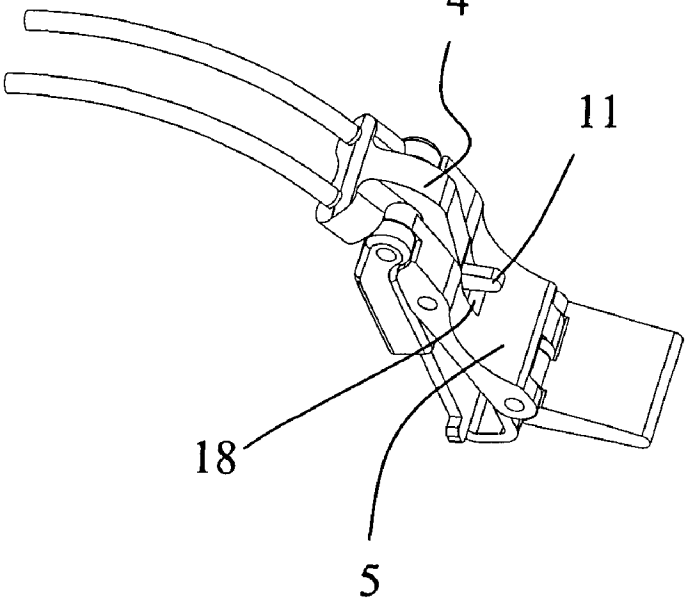

FIGS. 4 to 6 illustrate the buckle of this binding device in a closed position. This position is achieved from the docking position by a rotation of the closure and tightening lever 5 about the shaft 8 of the docking element 7. This rotation pulls the cables 3 downward by means of the link 4 connected to the rotation shaft 6 distinct from the shaft 8 which makes a rotary downward movement until it reaches a position of stable closure, which then makes it possible to keep the boot tightened for the practice of snowboarding. In this closed position, the hook-shaped end 17 of the lever lock 9 is positioned in the corresponding opening 15 of the second branch 14 of the U of the insert 2 in order to secure the position of the lever 5 while preventing inadvertent opening. However, this lever lock 9 is optional. The closure and tightening lever 5 comprises a notch 18 in its central portion traversed by the end of the docking lock 11 and the link 4 in this closed position.

The buckle may be opened in two ways. Either the lever lock 9 is opened and the lever 5 is raised to its top position, until returning to the stable docking position in which the buckle is not totally released from the insert 2. Or the end of the docking lock 11 in the shape of a lever is directly actuated to release it from the opening 13. This then automatically causes the whole buckle 1 to rise and the lever lock 9 to be released, particularly thanks to the opening 20 placed toward the upper end of the opening 15 of the second branch 14 of the insert 2. This second action therefore totally releases the buckle from the insert 2 and makes it possible to remove the surf boot. The duplication of the docking and tightening functions by distinct elements, and more particularly the use of a docking lock 11, therefore makes it possible to offer these different advantageous possibilities.

FIGS. 8 to 17 illustrate a second mode of execution of the invention in which the insert 22 mounted fixedly on one side of the base of the binding has a simplified geometry, since it comprises only one rod 32 furnished with an opening 33 to interact with the docking lever 31 mounted so as to be able to rotate on the buckle 21 about the shaft 28 of the docking element 27 on which the tightening lever 25 is also mounted. In this mode of execution, a lever lock 29 is mounted on the docking element 27, capable of interacting with a shaft 39 of the lever 25. This lever 25 also comprises a shaft 26 on which is mounted the link, not shown, to the cables, webbing, strap or equivalent element connected at the other side of the base and designed to tighten a portion of a boot to hold it on the snowboard.

The operation of this binding buckle 21 also has a first docking phase in which the buckle will be threaded onto the insert 22 whose rod 32 is positioned inside the funnel-shaped opening 36, made in the lower portion of the docking element 27. Under the prolonged force of this insertion, the end 40 of the docking lock 31 makes contact with the rod 32, is first separated by a rotation about the shaft 28 to free up the passage for the rod 32 inside the opening 36 of the docking element 27, then returned by its return spring, not shown, to the locked position in which its lower hook-shaped portion 40 is positioned inside the opening 33 of the insert 22. In this position, it is impossible to remove the buckle 21 without actuating the lock 31.

Figure 11:
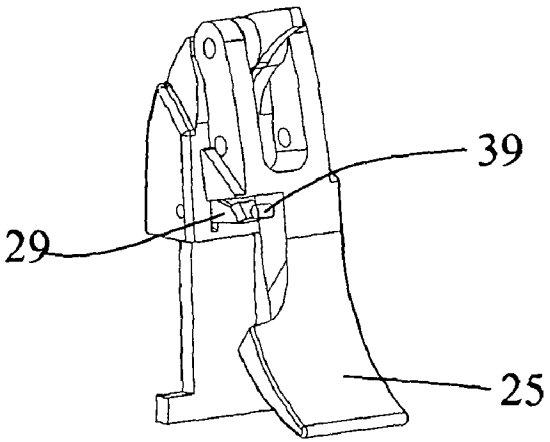
FIG. 11 represents a view in perspective of a buckle of a surf boot binding device in an almost closed position according to the second mode of execution of the invention.
Figure 12:
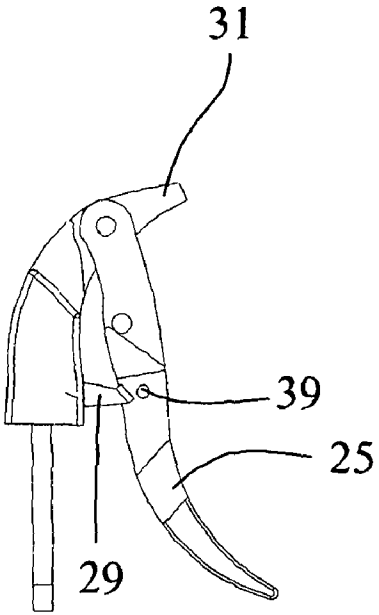
FIG. 12 represents a side view of the buckle of a surf boot binding device in an almost closed position according to the second mode of execution of the invention.
Figure 13:
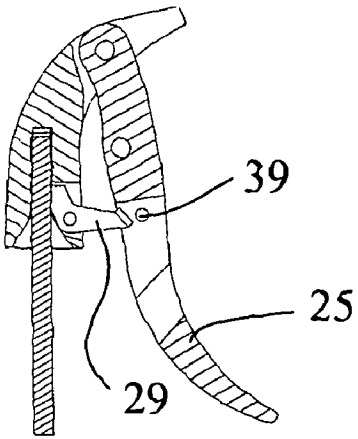
FIG. 13 represents a side view in section through a sectional plane passing at the lever lock of the buckle of a surf boot binding device in an almost closed position according to the second mode of execution of the invention.
Figure 16:
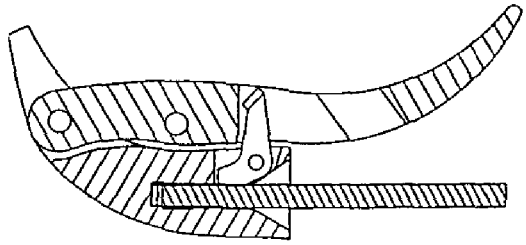
FIG. 16 represents a side view in section through a sectional plane passing at the lever lock of the buckle of a surf boot binding device in a closed position according to the second mode of execution of the invention.
Figure 15:
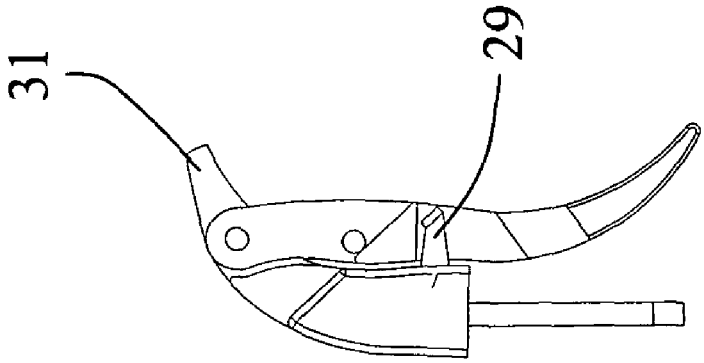
FIG. 15 represents a side view of the buckle of a surf boot binding device in a closed position according to the second mode of execution of the invention.
Figure 14:
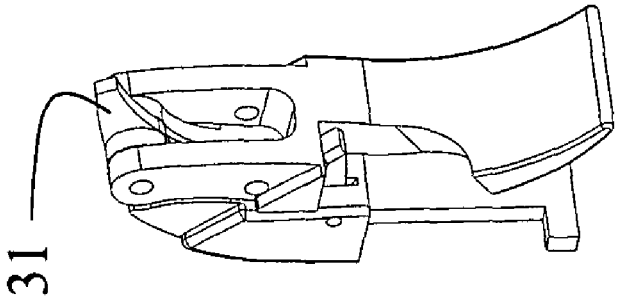
FIG. 14 represents a view in perspective of a buckle of a surf boot binding device in a closed position according to the second mode of execution of the invention.
Figure 17:
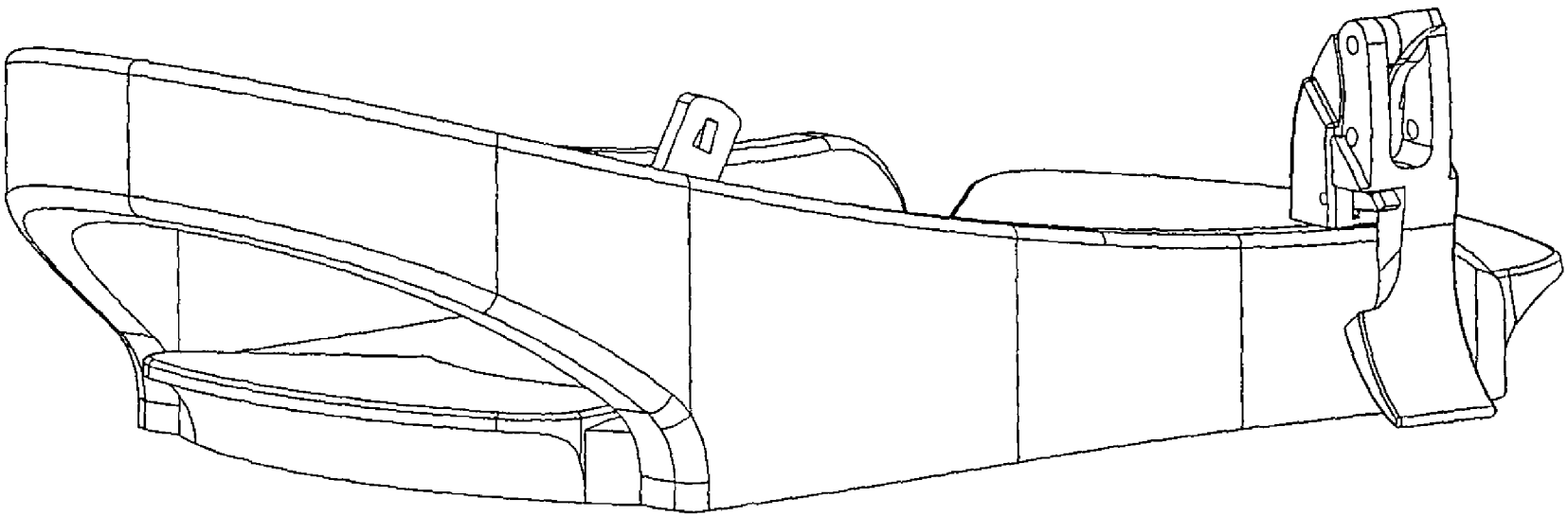
FIG. 17 represents a view in perspective of the buckle of a surf boot binding device in a closed position according to the second mode of execution of the invention.
Figure 18:
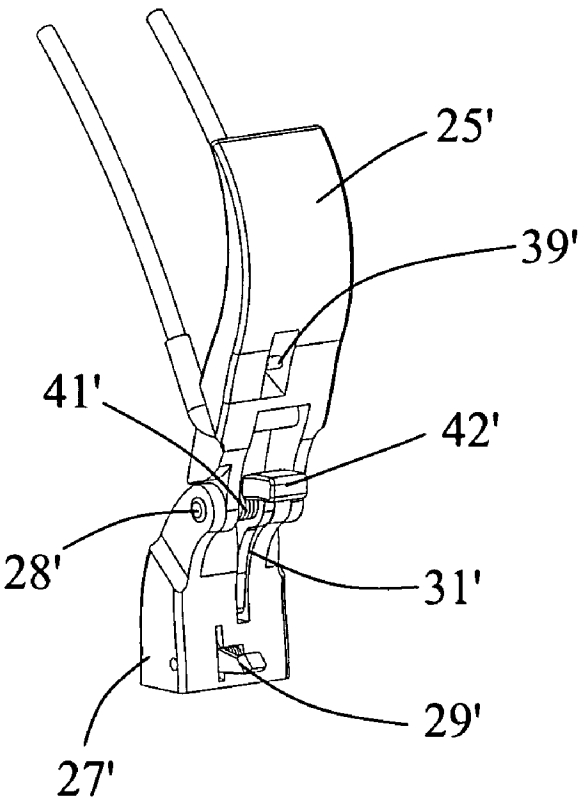
FIG. 18 represents a view in perspective of a buckle of a surf boot binding device in an open position according to a variant of the second mode of execution of the invention.
Figure 19:
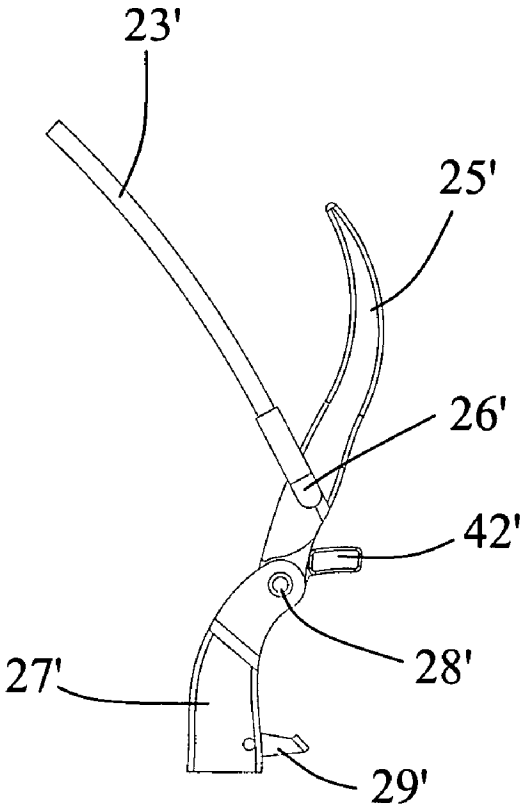
FIG. 19 represents a side view of the buckle of a surf boot binding device in an open position according to the variant of the second mode of execution of the invention.
Figure 20:
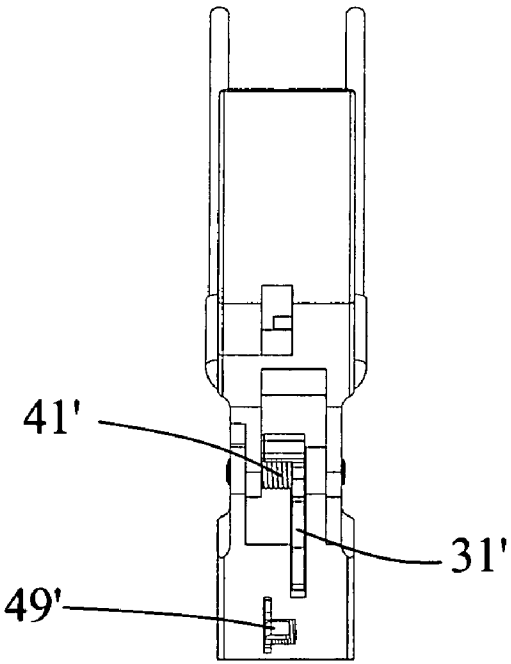
FIG. 20 represents a front view of the buckle of a surf boot binding device in an open position according to the variant of the second mode of execution of the invention.

The second tightening phase consists in lowering the lever 25 which will cause the cables or equivalents to tighten on the boot, as has been explained above. FIGS. 11 to 13 illustrate an almost final position of this phase, in which the lever 25 occupies a bottom position but without being locked, the lock 29 not yet interacting with the rod 39 of the lever. FIGS. 14 to 17 finally illustrate this second completed phase in which the lever 25 is locked, the lock 29 preventing it from rotating upward. Note that this lever lock can be locked only when docking is achieved, which represents an advantage in terms of safety of the solution.

Figure 21:
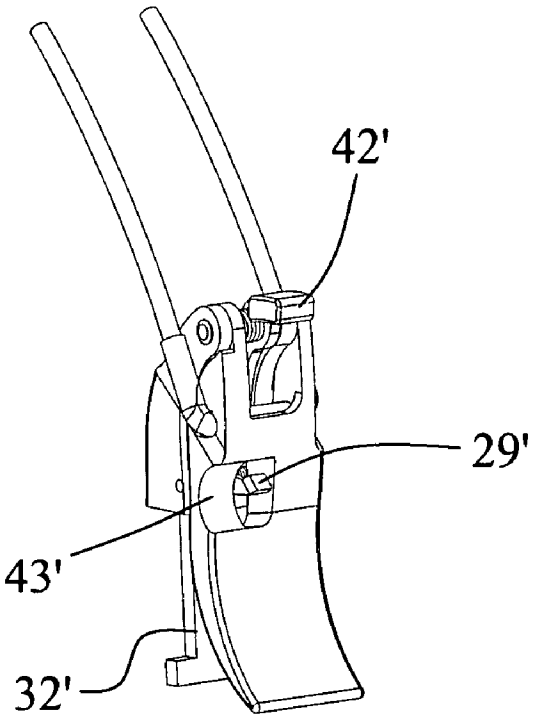
FIG. 21 represents a view in perspective of the buckle of a surf boot binding device in a closed position according to the variant of the second mode of execution of the invention.
Figure 22:
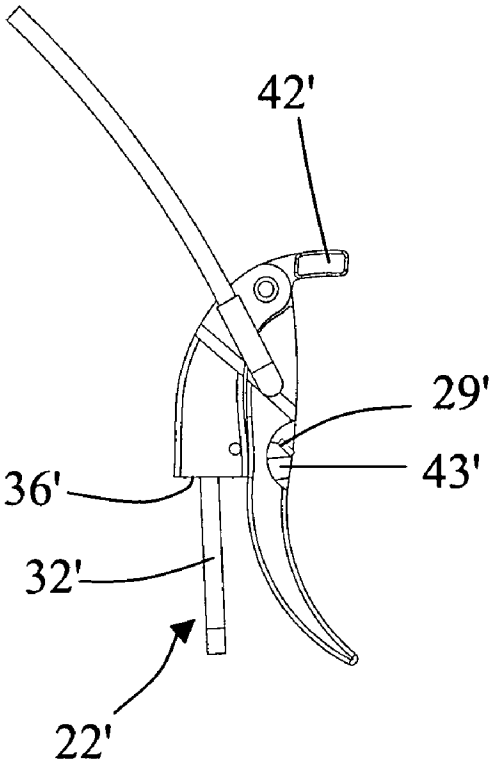
FIG. 22 represents a side view of the buckle of a surf boot binding device in a closed position according to the variant of the second mode of execution of the invention.
Figure 23:
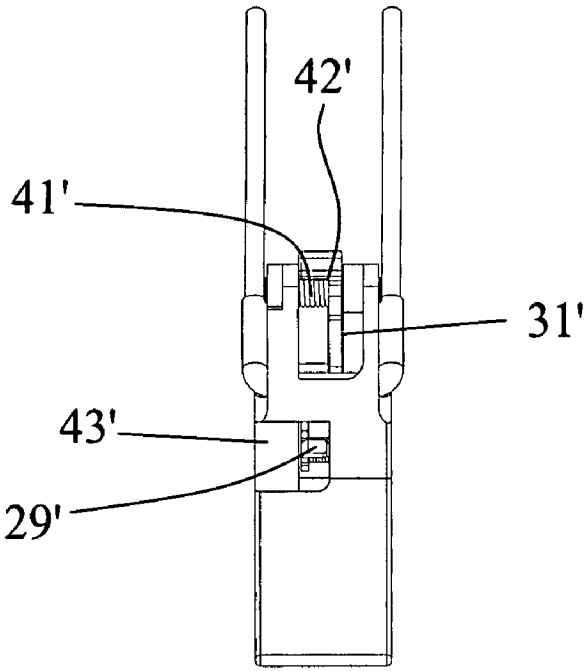
FIG. 23 represents a front view of the buckle of a surf boot binding device in a closed position according to the variant of the second mode of execution of the invention.

FIGS. 18 to 23 illustrate a variant embodiment of the second mode of execution of the invention in which a notch 43' is provided in the lever 25' to facilitate access to the lever lock 29' and its manual actuation in the closed position illustrated in FIG. 21. This lever lock 29' is associated with a spring 49' which tends to keep it in the closed position. The docking lock 31' comprises an end 42' that is protuberant and easily actuatable in the closed position and is also associated with a return spring 41' mounted on the shaft 28' which performs a double function of tending to keep the docking lock 31' in the closed position and tending to separate the lever 25' from the docking element 27'. In these figures, the link cables 23' connected to the buckle at the rotation shaft 26' are illustrated.

This variant embodiment makes it possible to relax the tightening of the binding by releasing the lever lock 29'. Following this action, the lever 25' automatically rises to its top position under the effect of the spring 41', which makes it possible to reach the intermediate docking position. It still remains possible to release the docking lock 31' by acting on the handle 42' in order to release the whole buckle 21' from the insert 22' so as to be able to release the boot from the binding.

In another variant embodiment not shown, it would be possible to provide a trigger making it possible to retract the shaft 39' from the lever 25' which interacts with the lever lock 29' in order to release this lock even more easily manually without having to act directly on the lever 29' with the fingers in the notch 43'.

FIGS. 24 to 27 illustrate a third mode of execution of the invention which differs from the previous ones with the particular geometry 57, 58, 57', 58', respectively of the docking lock 51, 51' and the tightening lever 45, 45' at the level of their rotation shafts 48, 48', in order to cooperate during their rotation. The variant of execution of FIGS. 25 to 27 differs from the one represented in FIG. 24 in that it presents a lever lock 49'.

Figure 25:
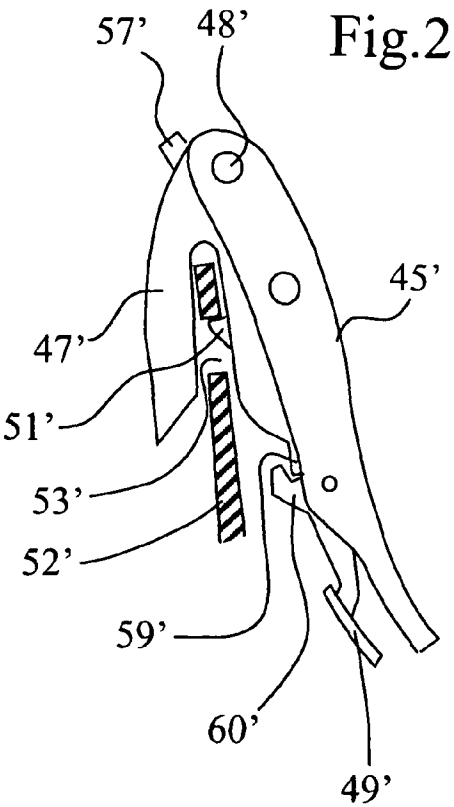
FIG. 25 represents a side view of the buckle of a surf boot binding device in a closed position according to a variant of the third mode of execution of the invention.
Figure 27:
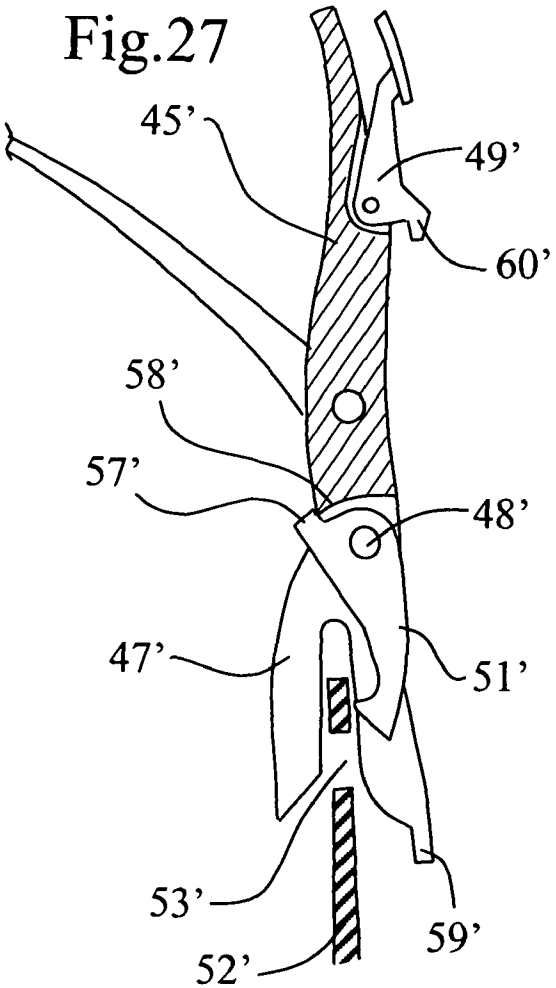
FIG. 27 represents a side view in section of the buckle of a surf boot binding device in an open position according to the variant of the third mode of execution of the invention.
Figure 26:
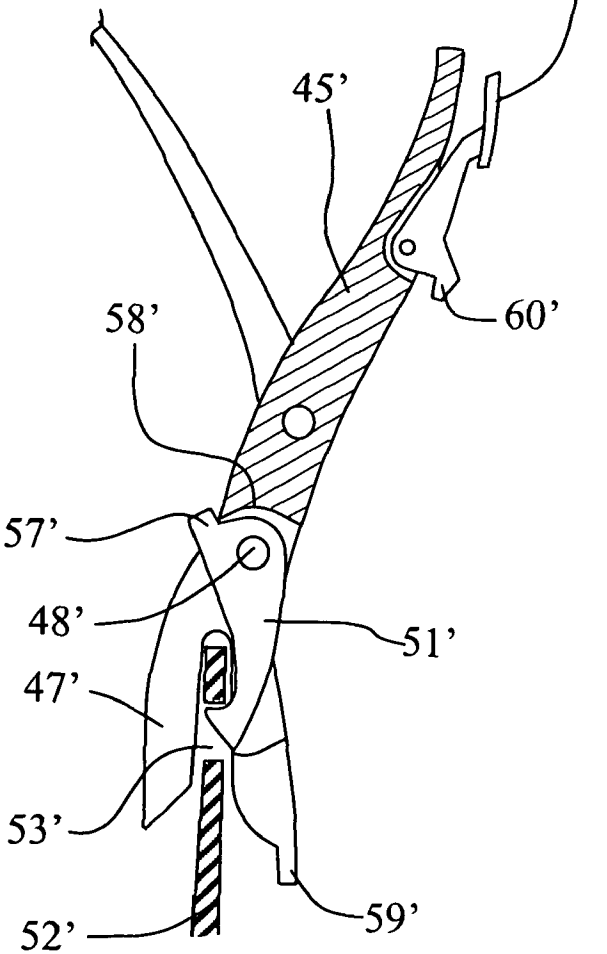
FIG. 26 represents a side view in section of the buckle of a surf boot binding device in an intermediate docking position according to the variant of the third mode of execution of the invention.

The operation specificities of this third mode of execution are explicated in reference with FIGS. 25 to 27.

Figure 24:
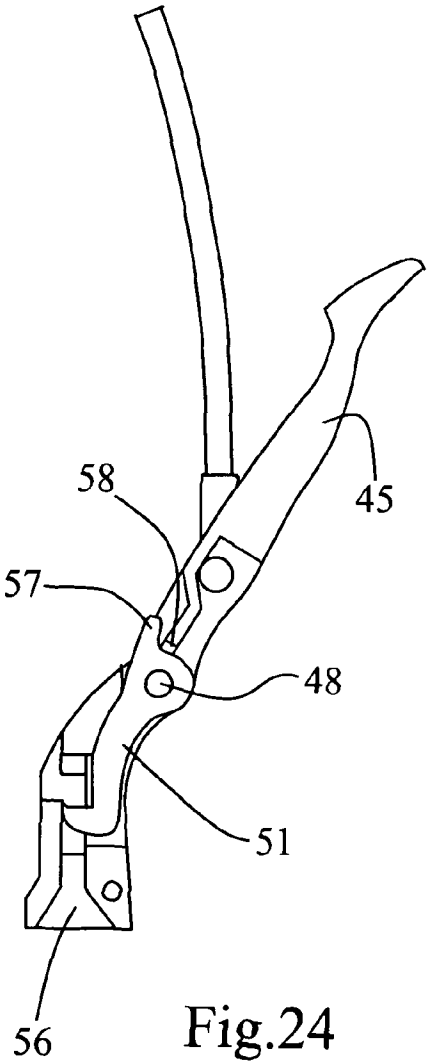
FIG. 24 represents a side view of the buckle of a surf boot binding device according to a third mode of execution of the invention.

FIG. 25 represents the device in closed position, the docking lever 51' being positioned within the aperture 53' of the insert 52'. In this position, the tightening lever 45' is in its lower position, a hook 60' at the end of the lever lock 49' cooperating with a complementary abutment 59' placed in the lower part of the docking element 47'. As a remark, this lever lock 49' is a security element which can be optional, as illustrated in FIG. 24, the balance position of the lever 45 being stable as soon as the buckle geometry assures that the traction force of the cable on the lever 45 in closed position tends to maintain such position.

The buckle aperture is illustrated in FIGS. 26 and 27. On FIG. 26, the lever lock 49' is locked and the lever 45' raided up to the intermediate docking configuration, the buckle remaining fixed to the insert by the docking lock 51'. The total release of the buckle, illustrated in FIG. 27, is obtained by continuing further the rotation in the opening direction of the tightening lever 45', whose end 58' acts on a protuberant part 57' of the docking lever 51' at the level of rotation shaft 48', inducing the rotation of the docking 51' in the opening direction, against the force of its return spring, non represented. Without this manual force of the user, the lever 45' remains automatically in intermediate position.

This third mode of execution of the invention presents the advantage to allow the total or partial aperture of the buckle through the actuation of the same lever; this is very user friendly and allows easily its manual operation with gloves for instance.

An advantage of the solution of the invention is therefore to provide a stable intermediate docking position thanks to a docking lock of a binding and tightening device, distinct in particular from the tightening lever, the lever lock and the docking element, which thus allows its secure and autonomous operation and an effective docking operation. During a binding and tightening phase, this intermediate docking phase makes it possible to divide the force into two phases securely. The first phase up to the locked docking does not require a major force and allows the correct positioning of the boot in its binding device and the correct positioning of the buckle on the side of the base. This first precision phase being completed and locked, it is then possible to begin the second tightening phase which requires a greater force, while being sure that there will be no release of the buckle, until the final tightening of the device that it is also possible to lock. Similarly, this solution also allows the opening of this device by again going through the intermediate stable docking phase to obtain a loosening of the boot without completely releasing it from the binding, which makes it possible to retighten it more easily as necessary while retaining the tightening adjustment. This intermediate position is locked and allows a movement with the sliding board while ensuring that there will be no accidental release of the boot, the boot however being relieved of a considerable tightness, useful in the rest phases, as when taking mechanical lifts for example. It may also be possible to totally release the buckle from the tightened position if necessary, in particular to release the boot from the binding, by actuating only the docking lock without operating the lever lock.

A device for adjusting tightness is of course compatible with the concept of the invention, which may be incorporated at any position in the buckle, according to known means of the prior art. The docking position then allows a relaxation of the tightness while facilitating the return to a tightness that is identical to the previous one, without having to again seek the correct tightness by trial and error.

Other variant embodiments are possible, originating particularly from the combination of the various elements of the embodiments described above. The invention is not limited to the geometries described above for the binding elements such as the insert, the docking element and the docking lock, which may take different forms without departing from the concept of the invention.

This solution has been illustrated for a device for attaching a boot to a sliding board but could also be implemented on a boot, such as a ski boot, surf boot or skate boot, for example, which also requires a closure and tightening device consisting in bringing together flaps of the boot, for which the solution could also be advantageous.

The invention claimed is:

1. A closure and tightening device comprising a buckle connected to a first end of a base of a device for attaching a boot to a sliding board, and an insert mounted on a second end of the base of the device for attaching a boot to a sliding board wherein the buckle comprises a tightening lever and a docking element, and the tightening lever is mounted so as to be able to rotate about a shaft located on the docking element and a docking lock rotatably mounted on the buckle and capable of locking/unlocking a binding of the docking element on a matching insert and wherein the tightening lever has two stable positions, corresponding to a docking position and to a closed position, respectively, said closed position being achieved from the docking position by a rotation of the tightening lever relative to the docking element to drive the buckle from a docking configuration to a closed configuration.

2. The closure and tightening device as claimed in claim 1, wherein the tightening lever is mounted so as to be able to rotate about a shaft positioned at the end of the docking element.

3. The closure and tightening device as claimed in claim 1, wherein the docking lock is distinct from the tightening lever and from the docking element and is mounted so as to rotate relative to the docking element.

4. The closure and tightening device as claimed in claim 1, wherein the docking lock has one end in the shape of a hook capable of interacting with a matching opening on an insert.

5. The closure and tightening device as claimed in claim 1, wherein the docking lock is such that its manual actuation releases the docking element and the tightening lever.

6. The closure and tightening device as claimed in claim 1, wherein the tightening lever comprises an element cooperating with an element of docking lock in order to allow the opening of the docking lock through the actuation of the tightening lever.

7. The closure and tightening device as claimed in claim 1, which comprises a linking element mounted so as to be able to rotate on a shaft distinct from the shaft on the tightening lever.

8. The closure and tightening device as claimed in claim 1, which comprises a lever lock to secure the closed position of the tightening lever while preventing any accidental opening.

9. The closure and tightening device as claimed in claim 1, wherein the buckle has a lever lock mounted so as to move on the docking element and interacting with a shaft of the tightening lever.

10. The closure and tightening device as claimed in claim 9, wherein the buckle has a trigger allowing the retraction of the shaft of the tightening lever or a notch for manual access to the lever lock in order to allow the manual opening of the tightening lever and the return to the docking position.

11. The closure and tightening device as claimed in claim 1, wherein the docking lock has a protuberant end in the tightened position of the device allowing by actuation, to totally release the buckle from the insert.

12. The closure and tightening device as claimed in claim 1, wherein the closure and tightening device is a surfing binding device.

13. A sliding board comprising a binding and tightening device as claimed in claim 1.

14. A sport boot with flaps comprising a buckle as claimed in claim 1 for closure and tightening.

15. A closure and tightening device comprising a buckle as claimed claim 1, connected to a first end of a base of a device for attaching a boot to a sliding board, and an insert mounted on the second end of the base of this device for attaching a boot to a sliding board, the buckle being separate from the insert in an open position, the docking element buckle being fixed in a stable unique position on the insert with the tightening lever in a first stable non tightening position in an intermediate docking position, the docking element buckle being fixed in the stable unique position on the insert with the tightening lever in a second stable tightening position in a closed position.

16. A closure and tightening device buckle comprising a tightening lever and a docking element, wherein the tightening lever is mounted so as to be able to rotate about a shaft relative to the docking element and wherein the closure and tightening device buckle further comprises a docking lock capable of locking/unlocking a binding of the docking element on a matching insert, wherein the docking lock is mounted so as to be able to rotate about the shaft relative to the docking element.

17. The closure and tightening device as claimed in claim 1, wherein a return spring acts on the docking lock to tend to rotate the docking lock into the closed position and wherein the docking lock has a protuberant end allowing the docking lock to be operated in the direction opposite to the force of the spring.

18. The closure and tightening device as claimed in claim 17, wherein the return spring also acts on the tightening lever to tend to rotate the tightening lever in the direction of loosening by separating the tightening lever from the docking element.

19. A closure and tightening device comprising:

a closure and tightening device buckle, said closure and tightening device buckle comprising:

a tightening lever and a docking element, wherein the tightening lever is mounted so as to be able to rotate about a shaft relative to the docking element and a docking lock capable of locking/unlocking a binding of the docking element on a matching insert wherein said closure and tightening device buckle is connected to a first end of a base of a device for attaching a boot to a sliding board, and an insert mounted on the second end of the base of this device for attaching a boot to a sliding board, and wherein the insert mounted on the second end of the base has a vertical plate interacting with a lower opening of the docking element of the buckle and wherein the vertical plate comprises an opening interacting with the docking lock of the docking element.

20. The closure and tightening device as claimed in claim 19, wherein the lower opening of the docking element is funnel-shaped to make the insert easier to insert.

21. A closure and tightening device comprising:

a closure and tightening device buckle, said closure and tightening device buckle comprising:

a tightening lever and a docking element, wherein the tightening lever is mounted so as to be able to rotate about a shaft relative to the docking element and a docking lock capable of locking/unlocking a binding of the docking element on a matching insert wherein said closure and tightening device buckle is connected to a first end of a base of a device for attaching a boot to a sliding board, and an insert mounted on the second end of the base of this device for attaching a boot to a sliding board, and wherein the buckle has a lever lock mounted so as to be able to rotate about a shaft toward one end of the tightening lever and comprises a hook-shaped end to interact with an opening of a vertical plate of the insert.

22. The closure and tightening device as claimed in claim 21, wherein the opening of the vertical plate of the insert comprises an opening in its upper portion in order to allow the release of the tightening lever and of the whole buckle in case the docking lock opens.

23. A closure and tightening device buckle comprising a tightening lever and a docking element, wherein the tightening lever is mounted so as to be able to rotate about a shaft relative to the docking element, wherein the closure and tightening device buckle further comprises a docking lock capable of locking/unlocking a binding of the docking element on a matching insert, and wherein the tightening lever can occupy two stable positions relative to the buckle, a tightened and a non tightened, when the docking element is fixed on a matching insert.

24. A closure and tightening device comprising:

a buckle connected to a first end of a base of a device for attaching a boot to a sliding board, and an insert mounted on a second end of the base of the device for attaching a boot to a sliding board, wherein the buckle comprises a tightening lever and a docking element, and the tightening lever is mounted so as to be able to rotate about a shaft located on the docking element and a docking lock rotatably mounted on the buckle and capable of locking/unlocking a binding of the docking element on the matching insert, wherein the tightening lever has two stable positions, corresponding to a docking position and to a closed position, respectively, said closed position being achieved from the docking position by a rotation of the tightening lever relative to the docking element to drive the buckle from a docking configuration to a closed configuration, and wherein the docking lock is able to lock the buckle on the matching insert in the docking position.

* * * * *